US006634859B2

(12) United States Patent
Weigand et al.

(10) Patent No.: US 6,634,859 B2
(45) Date of Patent: Oct. 21, 2003

(54) APPARATUS AND PROCESS FOR IMPINGEMENT COOLING OF A COMPONENT EXPOSED TO HEAT IN A FLOW POWER MACHINE

(75) Inventors: Bernhard Weigand, Filderstadt (DE); James P. Downs, Juno Beach, FL (US)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/006,725

(22) Filed: Dec. 10, 2001

(65) Prior Publication Data

US 2002/0168264 A1 Nov. 14, 2002

(30) Foreign Application Priority Data

Dec. 22, 2000 (DE) ..... 100 64 271

(51) Int. Cl.[7] ..... F01D 5/18
(52) U.S. Cl. ..... 416/97 R; 415/115; 415/121.2
(58) Field of Search ..... 416/97 R, 96 R, 416/96 A, 97 A, 95; 415/115, 116, 121.2

(56) References Cited

U.S. PATENT DOCUMENTS 5,403,159 A * 4/1995 Green et al. ..... 416/97 R
5,603,606 A 2/1997 Glezer et al.
5,688,104 A 11/1997 Beabout
5,690,473 A * 11/1997 Kercher ..... 416/97 A
5,931,638 A * 8/1999 Krause et al. ..... 416/97 R
6,238,183 B1 * 5/2001 Williamson et al. ..... 416/96 A
6,347,923 B1 * 2/2002 Semmler et al. ..... 416/97 R

FOREIGN PATENT DOCUMENTS

| | | |
|---|---|---|
| DE | 2237154 | 5/1973 |
| DE | 3248162 A1 | 7/1983 |
| DE | 3642789 C2 | 4/1996 |
| DE | 4441507 C2 | 9/1996 |
| DE | 4003803 C2 | 6/1999 |
| GB | 2343486 | 5/2000 |

* cited by examiner

*Primary Examiner*—Edward K. Look
*Assistant Examiner*—J. M. McAleenan
(74) *Attorney, Agent, or Firm*—Burns, Doane, Swecker & Mathis, L.L.P.

(57) ABSTRACT

An apparatus and a process are provided for impingement cooling of a component exposed to heat in a flow machine. The component includes a wall section on at least one side of which at least one impingement air flow impinges, the air flow passing through a flow channel within a surface element arranged spaced apart from the wall section and striking against the wall section to be cooled. The flow channel has an inlet aperture and an outlet aperture, with the outlet aperture directly facing toward the wall section to be cooled, and the inlet aperture has a throughflow cross section which is smaller than the throughflow cross section of the outlet aperture.

12 Claims, 4 Drawing Sheets

APPARATUS AND PROCESS FOR IMPINGEMENT COOLING OF A COMPONENT EXPOSED TO HEAT IN A FLOW POWER MACHINE

FIELD OF THE INVENTION

The invention relates to an apparatus for impingement cooling of a component exposed to heat in a flow machine. The component has a wall section to be cooled which is acted on, on at least one side, by at least one impingement cooling air stream. The impingement cooling air stream passes through a flow channel within a surface element spaced apart from the wall section to be cooled and strikes the wall section to be cooled. Furthermore the invention relates to a cooling process related to this and to a process for the production of a heat resistant component.

BACKGROUND OF THE INVENTION

The maximum output power attainable with modern gas turbine plants, and also the efficiency attainable with these plants, depend directly on the combustion temperatures attainable within the combustor, and at which the resulting hot gases flow through the turbine stages provided downstream. From purely thermodynamic viewpoints, the efficiency of such flow power machines could be definitely raised by an increase of the combustion temperatures attainable within the combustor, but limits are set on this endeavor by the materials of those components which are directly or indirectly impinged on by the hot gases. Thus, depending on the materials, care has to be taken to keep the temperatures prevailing within gas turbines below the melting temperatures of the respective components concerned. In order to be able to attain the highest possible combustion temperatures, new, high temperature resistant materials are always being developed, and cooling measures are found in order to cool those components directly exposed to the hot gases, so that the thermal stress is reduced and the life of the components is increased.

From the many components to be cooled within a gas turbine plant, it is precisely the guide and rotor blades within a turbine stage directly following the combustor which are not only exposed to the hot gases, but also have to withstand high mechanical loads.

Usually cooling air is specifically applied to such components. The cooling air is branched off in partial flows from sides of the compressor and conducted directly to the components to be cooled through correspondingly provided cooling channels. In particular, it is effective to cool those regions of the turbine blade which are exposed to a particularly heavy thermal stress. This primarily concerns the turbine blade front edge, upon which the hot gases strike directly, bringing about particularly high heat transfer numbers in this region. The maximum of the so-called external heat transfer coefficient is typically reached at those places of the turbine blade front edge upon which the hot gases strike perpendicularly and thus lead to a maximum ram action on the turbine blade front edge. Cooling with maximum efficiency at just these places is essential in order not to exceed the temperature limits that depend on the materials.

A preferred technique for cooling the turbine blade front edge is based on the specific cooling air supply within the turbine blade along the cooling channels situated within the blade, the cooling air being conducted past, directly on the inside of the turbine blade front edge in order to cool the front edge convectively.

A turbine blade constituted in this manner can be gathered, for example, from U.S. Pat. No. 5,603,606, in which according to FIG. 1 in this document a cross section is shown through the forward region of a turbine blade, which has a cooling air channel 166 which is connected via a connecting gap 180 to a forward cooling volume 168 that directly borders on the interior of the turbine blade at the turbine blade front edge. The connecting channel 180 is bounded on one side by the turbine blade inner wall, so that the cooling air conducted into the forward volume region flows tangentially over the inside of the turbine blade front edge. The whole region of the turbine blade front edge is hereby acted on by an internal cooling air flow; however, this is able to cool only insufficiently just the abovementioned hot regions along the turbine blade front edge.

In order to improve the contact, and the related heat exchange, between the cooling air flow, it was proposed in DE 32 481 62 C2 to install rib elements on the wall surface to be cooled, with their rib long axes oriented at about 45° to the direction of the cooling air flow. The heat transfer between the cooling air flow and the surface to be cooled can be improved by the measure described above; however, the cooling air flows only tangentially to the surface to be cooled, so that particularly hot regions of the wall surface are likewise not cooled to a sufficient extent.

In order to eliminate this disadvantage, a cross section through the front region of a turbine blade 1 is shown in FIG. 4. To clarify the heating problem, schematic flow lines 2 represent the hot gases striking the turbine blade front edge 3. In particular in that region of the turbine blade front edge 3 at which the hot gas flow 2 strikes nearly perpendicularly on the turbine blade front edge, an extremely strong temperature rise takes place within the material of the turbine blade. It is just this region which has to be cooled particularly effectively. For this purpose, an internal cooling channel 4 is provided for the turbine blade 1, and is connected with a forward volume 6 by means of at least one connecting channel 5, which is situated in a partition 8, and into which there likewise projects an outlet channel 7 connected to the upper side of the turbine blade.

Cooling air which is supplied at high pressure via the cooling channel 4 enters at high speed into the volume 6 through the flow channel 5 and strikes the region 3 of the turbine blade front edge. This cooling technique, known as impingement cooling, in contrast to the abovementioned cooling techniques, is able to strongly cool that region on the turbine blade front edge which is most heavily thermally stressed by the hot gases. More exact investigations of the impingement air flow, known per se, passing through the connecting channel toward the turbine blade front edge to be cooled show however that the flow channel, constituted straight, only permits a widening out of the cooling flow on leaving the connecting channel. Only small surfaces on the inside of the turbine blade front edge are hereby effectively acted on by cooling air, and the cooling effect is restricted to only a greatly limited region. A further disadvantage of the straight constitution of the cooling channel is that the emerging cooling flow very heavily cools a very small region and therefore contributes to very high temperature gradients and the resulting stress gradients in the material.

SUMMARY OF THE INVENTION

The invention provides an apparatus for the impingement cooling of a component exposed to heat in a flow machine, preferably a turbine blade, according to the abovementioned category, so that the region of the heat-stressed turbine blade front edge is cooled as effectively and optimally as possible, thereby allowing higher combustor temperatures and/or a reduction of the cooling requirement.

According to an embodiment of the invention, an apparatus is provided for impingement cooling of a component exposed to heat in a flow machine. The component includes a wall section exposed on at least one side to an impingement cooling flow which passes through a flow channel within a surface element spaced apart from the wall section to be cooled and strikes against the wall section to be cooled. The flow channel has an inlet aperture and an outlet aperture, with the outlet aperture directly facing the wall section to be cooled, and the inlet aperture having a flow cross section which is smaller than the flow cross section of the outlet aperture.

An idea on which the invention is based, in contrast to the prior art, has the flow channel embodied such that the cooling flow passing through the flow channel is strongly fanned out divergently, and in this manner covers a greater region of the turbine blade front edge to be cooled. If the contour of the flow channel is formed according to the invention with a flow cross section widening out in the flow direction, the pressure losses are moreover reduced, which again is of benefit to the cooling action of the cooling air stream passing through the flow channel, especially as the impingement air cooling flow through the flow channel is slowed down. This is likewise the reason why the flow losses which arise directly at the outlet opening of conventionally constituted flow channels can be considerably reduced.

By the measures according to the invention, not only can the cooling action be considerably improved in the region of the turbine blade front edge, but also the impingement air cooling flow, striking divergently on the inner side of the turbine blade front edge, contributes to a better equalization of the temperature gradient which is formed within the turbine blade front edge. This also likewise reduces the mechanical stresses arising within the turbine blade, so that a definite contribution to the reduction of material fatigue is provided. The invention contributes to a homogenizing of the heat transfer numbers occurring along the turbine blade surface due to the internal cooling. Overheated places along the turbine blade front edge, over which the ram pressure of the hot gases has a maximum, can be effectively avoided.

BRIEF DESCRIPTION OF THE DRAWINGS

The invention is described hereinafter by means of examples, without limitation of the general concept of the invention, using embodiment examples with reference to the accompanying drawing.

DETAILED DESCRIPTION OF THE PREFERRED EMBODIMENTS

Figure 1:
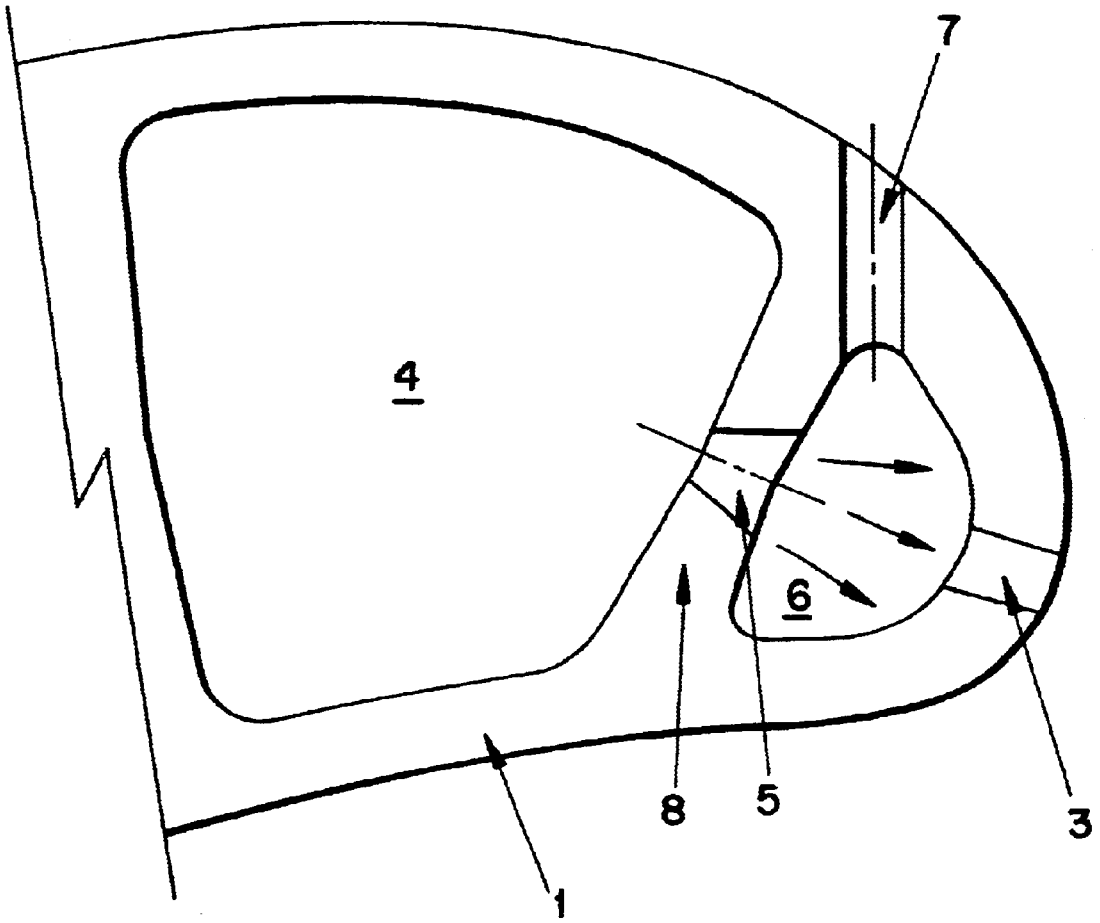
FIG. 1 is a cross sectional view through the forward portion of a turbine blade with impingement air cooling constituted according to the invention.

FIG. 1 shows the forward region of a turbine blade 1 in a cross sectional view, with a main cooling channel 4, which is connected via a flow channel 5 to a forward cooling volume 6. The forward cooling volume 6 is separated from the main cooling channel 4 by a partition 8. The forward cooling volume 6 has an outlet channel 7 which opens at the surface of the turbine blade 1. The cooling air supplied through the main cooling channel 4 passes at high pressure through the flow channel 5 and strikes against the inner wall of the turbine blade 1 situated opposite the flow channel 5 in the region of the turbine blade front edge 3. According to the invention, the flow channel 5 is constituted with a flow cross section which widens out in the flow direction, so that the cooling air passing through the flow channel 5 in the form of an impingement air cooling stream emerges divergently from the flow channel 5 and thus impinges on a greater region of the turbine blade front edge 3.

Figure 2:
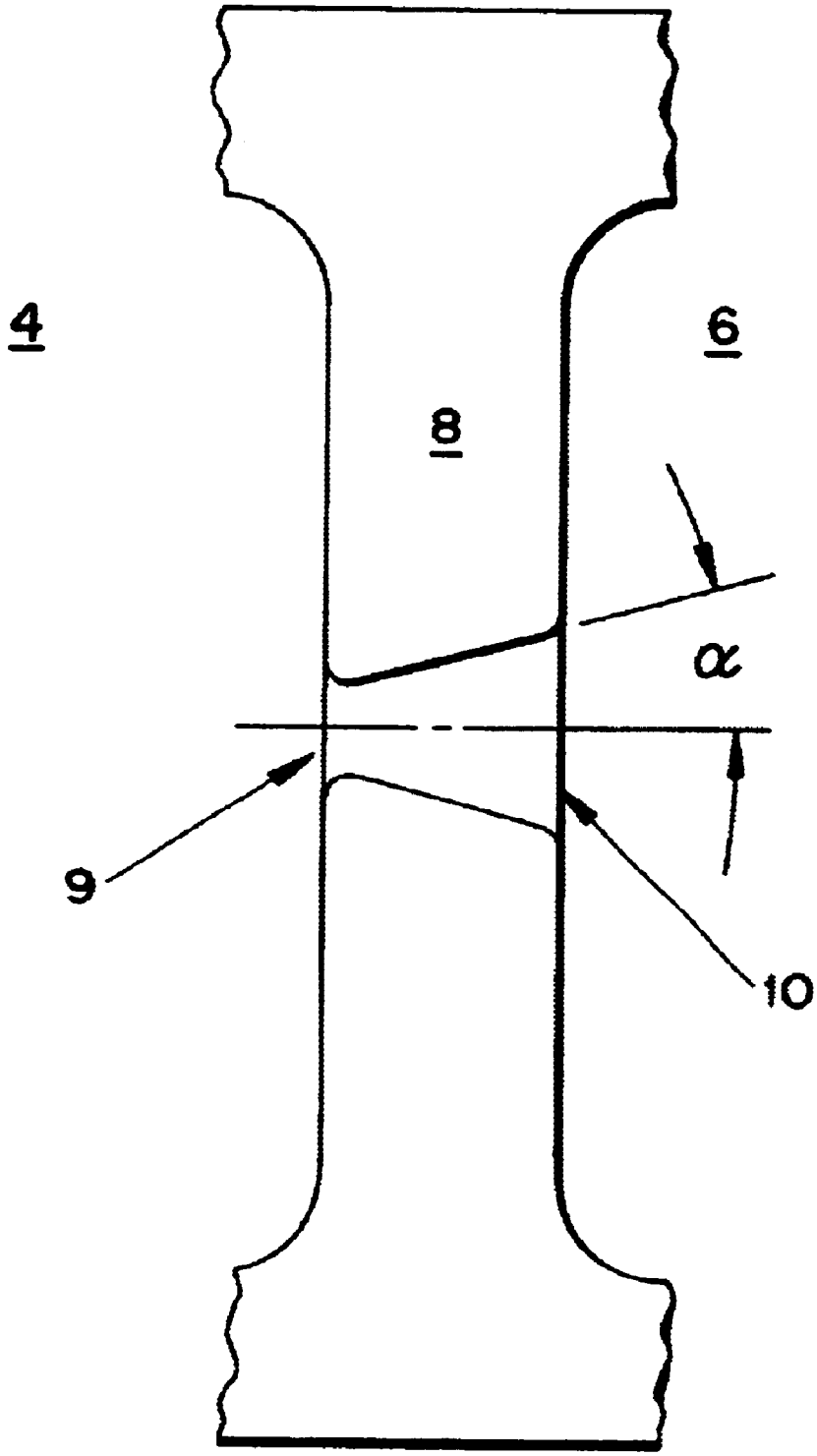
FIG. 2 is a detail view of a flow channel constituted according to the invention.

FIG. 2 shows a detailed diagram relating to the geometrical construction of the flow channel 5, which is provided within the partition 8 that separates the main cooling channel 4 from the forward volume 6. The flow channel has an inlet aperture 9 and also an outlet aperture 10, the inlet aperture 9 having a smaller cross section, or a smaller aperture diameter, than the outlet aperture 10. In the embodiment example shown, the flow channel 5 is constituted conically widening and has bounding walls cut in a straight line. It is however also possible to provide funnel-shaped, curved bounding wall contours. The impingement air cooling flow propagating along the flow channel 5 widens out divergently in flow profile after passage through the flow channel. This allows the air cooling flow to impinge on the largest possible region of the turbine blade front edge 3, thereby providing impingement air cooling.

Typically, the aperture angle a shown in FIG. 2 and included between the mid-axis through the flow channel 5 and a bounding wall has values between 2° and 9°. Typical average diameters for the flow channel 5 are in the range between 0.5 and 7 mm.

Figure 3:
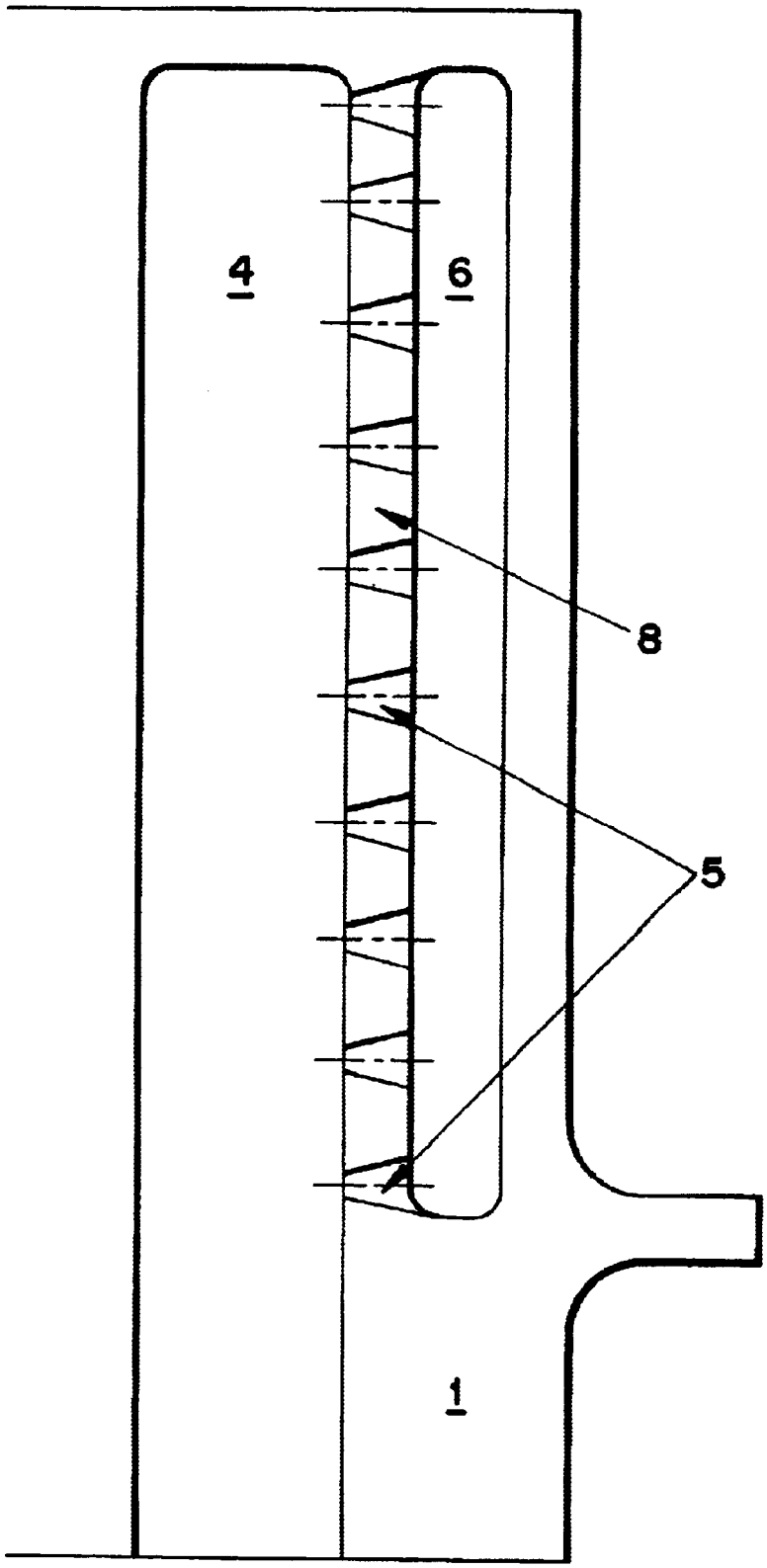
FIG. 3 is a schematized longitudinal sectional view through a turbine blade.

A longitudinal section through the forward region of a turbine blade 1 is shown in FIG. 3, with the main cooling channel 4, the front volume 6, and also the partition 8, in which numerous individual flow channels 5 are distributed radially of the turbine blade 1. All the individual flow channels 5 are oriented relative to the turbine blade front edge 3 so that the individual impingement air streams passing through the flow channels are able to directly cool the inner wall of the turbine blade front edge.

For the production of the turbine blade constituted according to the invention, the conventional casting process is suitable, in which, within a casting mold for forming the flow channels constituted according to the invention, heat resistant insert shapes are provided which are subsequently removed from the casting in order to lay open the free flow channels.

Figure 4:
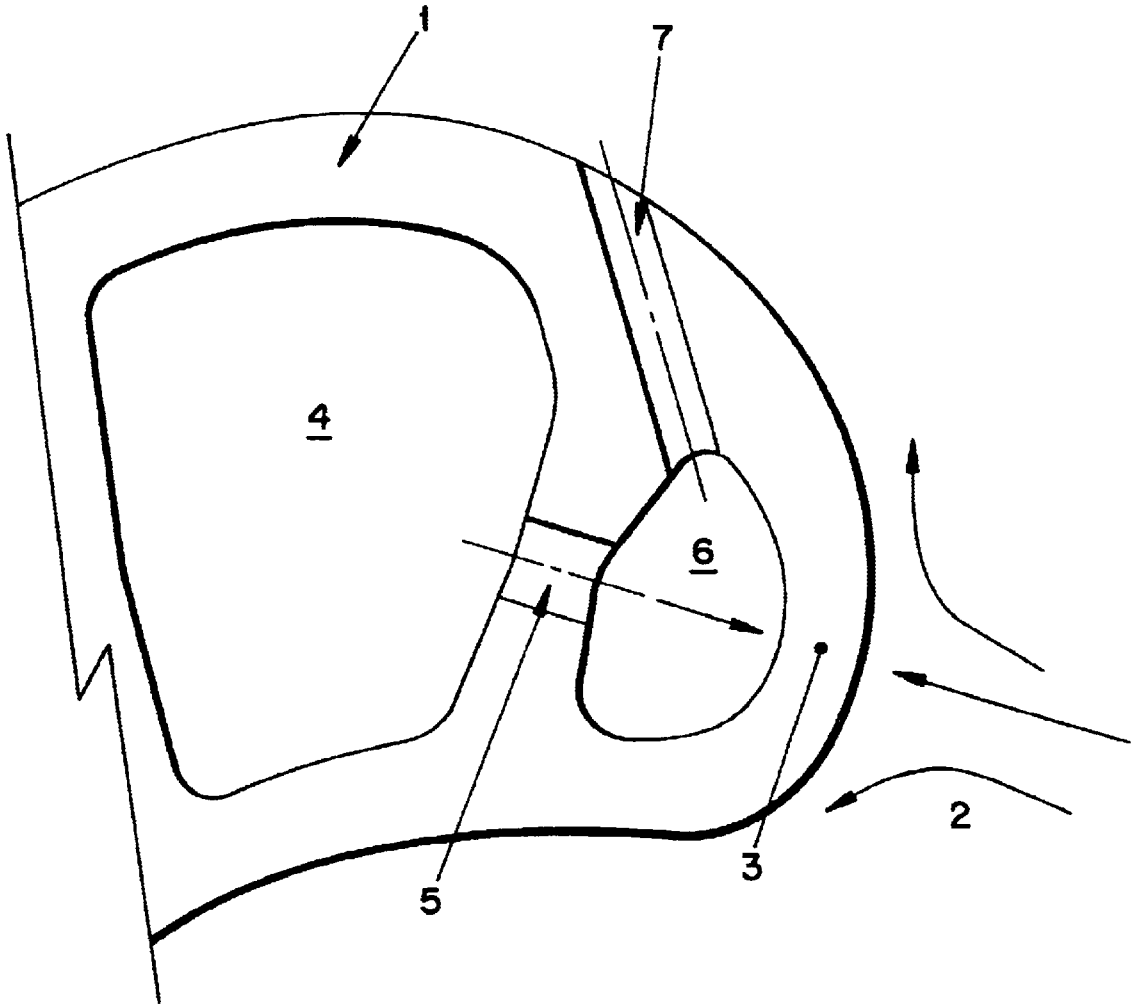
FIG. 4 is a cross sectional view through the forward portion of a turbine blade according to the state of the art.

In contrast to the present invention, FIG. 4 illustrates a flow channel within a conventional turbine blade.

What is claimed is:

1. An apparatus for impingement cooling of a component exposed to heat in a flow machine, comprising:

a wall section to be cooled, said wall section being exposed on at least one side to at least one impingement air cooling flow;

a surface element spaced apart from the wall section to be cooled and at least one flow channel being defined therethrough, the at least one impingement air cooling flow passing through the at least one flow channel and striking against the wall section to be cooled; and each of the at least one flow channel having an inlet aperture and an outlet aperture, the outlet aperture directly facing the wall section to be cooled, and the inlet aperture having a flow cross section which is smaller than the flow cross section of the outlet aperture, and wherein the longitudinal axes of the at least one flow channel is perpendicular to the wall section to be cooled.

2. The apparatus according to claim 1, wherein the at least one flow channel has a cross section which widens out in the flow direction.

3. The apparatus according to claim 1 or 2, wherein the at least one flow channel has a central, longitudinal axis, and in a longitudinal section through the at least one flow channel, a line joining a point of the inlet aperture to a point of the outlet aperture, both points being situated in the longitudinal section and on the same side of the central, longitudinal axis, the line forms an angle with the axis in the range from 2° through 9°.

4. The apparatus according to claim 3, wherein the flow machine is a gas turbine, and the component exposed to heat is a turbine blade, whose wall section to be cooled is the turbine blade front edge.

5. The apparatus according to claim 4, wherein at least one cooling channel is provided extending radially relative to the turbine blade, the cooling channel being bounded by a partition in the direction of the turbine blade front edge;

the partition enclosing a volume with the turbine blade wall in the region of the turbine blade front edge; and the partition forming the surface element with at least one flow channel, and the turbine blade wall facing toward the partition is the wall section to be cooled.

6. The apparatus according to claim 5, wherein a plurality of flow channels are arranged in a radial direction within the partition.

7. The apparatus according to claim 5, wherein at least one outlet channel is provided to extend out of the volume enclosed by the partition and the turbine blade wall.

8. The apparatus according to claim 7, wherein the at least one outlet channel projects through the turbine blade wall.

9. The apparatus according to claim 1, wherein the inlet aperture has an aperture diameter of at least 0.5 mm.

10. A process for cooling a component exposed to heat, wherein the component includes a wall section to be cooled, the process comprising:

impinging the wall section on at least one side with an impingement air cooling flow, wherein the impingement air cooling flow is directed with a divergent flow profile onto the wall section to be cooled, wherein the longitudinal axes of the at least one flow channel is perpendicular to the wall section to be cooled.

11. The process according to claim 10, wherein cooling air is conducted through a flow channel with a flow cross section running divergently in the flow direction and, downstream of the flow channel, directly strikes against the wall section to be cooled.

12. The apparatus according to claim 1, wherein the at least one cooling hole is contoured to be funnel shaped with curved walls.

* * * * *